US005575126A

United States Patent [19]

Attaway et al.

[11] Patent Number: 5,575,126

[45] Date of Patent: Nov. 19, 1996

[54] FLAT EXPANSION JOINT GASKET

[75] Inventors: Julian J. Attaway, Marietta; Richard J. Gladue, Conyers; Larry M. Petree, Lawrenceville; Claude M. Schuerman, Norcross, all of Ga.

[73] Assignee: MM Systems Corp., Tucker, Ga.

[21] Appl. No.: 174,207

[22] Filed: Dec. 28, 1993

[51] Int. Cl.[6] ..... E04B 1/682

[52] U.S. Cl. ..... 52/396.02; 52/393; 404/48

[58] Field of Search ..... 52/396.02, 396.03, 52/396.04, 396.05, 396.06, 396.07, 396.08, 396.09, 396.1, 573.1, 393; 404/48, 67, 68, 69

[56] References Cited

U.S. PATENT DOCUMENTS

| | | | |
|---|---|---|---|
| 3,485,149 | 12/1969 | Boney | 52/396.06 |
| 3,797,188 | 3/1974 | Mansfeld | 52/396.05 |
| 4,043,693 | 8/1977 | Brown | 52/396.02 X |
| 4,148,167 | 4/1979 | Puccio . | |
| 4,362,428 | 12/1982 | Kerschner | 52/396.02 X |
| 4,366,167 | 1/1983 | Huber et al. | 404/64 X |
| 4,437,785 | 3/1984 | Puccio | 52/396.06 X |
| 4,674,252 | 6/1987 | Nicholas et al. | 52/396.06 |
| 4,685,825 | 8/1987 | Buckenauer | 52/396.06 X |
| 4,799,345 | 1/1989 | Rizza | 52/396.06 |
| 4,916,878 | 4/1990 | Nicholas | 52/396.06 |
| 5,048,249 | 9/1991 | Shreiner et al. | 52/403 |

FOREIGN PATENT DOCUMENTS

| | | | |
|---|---|---|---|
| 1510622 | 5/1978 | United Kingdom | 404/66 |

*Primary Examiner*—Carl D. Friedman
*Assistant Examiner*—Creighton Smith
*Attorney, Agent, or Firm*—Needle & Rosenberg, P.C.

[57] ABSTRACT

An elastomeric, longitudinally continuous, elongate gasket for an expansion joint cover is described. The gasket has, in cross section, a central body portion and two side portions, one at each edge of the central body portion. The central body portion has horizontal top and bottom walls. The top wall may have a flat upper surface, and includes a series of regularly spaced, longitudinal regions having alternately greater and lesser resistance to lateral compressive forces. The bottom wall, which need not have a completely flat lower surface, includes a similar series of regularly spaced, longitudinal regions, with regions of lesser resistance on one wall being disposed vertically opposite regions of greater resistance on the other wall. Internal walls joining stronger regions of the top and bottom walls form a series of alternating diagonal struts which tend to reinforce and enhance the stability of the upper wall. The gasket may also include a longitudinal channel formed in the bottom wall for a spline, the insertion of which provides further reinforcement for the gasket. The side portions of the gasket are provided for attaching the gasket to structural members of the joint.

18 Claims, 6 Drawing Sheets

FLAT EXPANSION JOINT GASKET

BACKGROUND OF THE INVENTION

1. Field of the Invention

This invention relates to a gasket suitable for spanning a joint between two adjacent floor sections, and more particularly to a flat expansion joint gasket that is resistant to upward bowing under compression.

2. Description of the Prior Art

Expansion joints are commonly used between floor sections in both load bearing and non-load bearing applications. Usually, a compressible gasket is used to cover the joint and to maintain a flat surface between the floor sections. These gaskets traverse a joint and frequently are required to bear a load.

Prior art gaskets designed for use in such applications are known. U.S. Pat. No. 5,048,249 describes an expansion joint floor covering having a cellular core structure made up of a multiplicity of longitudinally extending cells defined by transversely spaced-apart generally vertical walls and vertically spaced apart upper and lower walls interconnecting the top and bottom edges of the vertical walls. The bottom of each cell is preferably formed in two upwardly converging angular wall sections which are adapted to fold in accordion-like fashion to accommodate transverse expansion and compression. The upper wall has a slightly concave surface when the gasket is in the relaxed, or uncompressed shape. In practice, it has been found that gaskets of this or similar construction can still bow upward to an unacceptable extent. It is believed that the pleated and relatively compressible lower wall of this gasket tends to preferentially absorb the initial lateral compression force, making it shorter in length than the upper wall. Because the upper wall is comparatively thick and less compressible, it tends to initially bow upward as a unit. The upper wall is then no longer parallel to the direction of the applied lateral compressive force, so the application of further compressive force tends not to compress the top wall, but rather to bend it further, unlike the bottom wall. Aside from presenting a displeasing appearance, such a deformed gasket can easily be damaged by traditional floor cleaning equipment, and also presents a tripping hazard.

A transverse cross section of a prior art gasket 10 is illustrated in FIG. 1(A) and (B). The nominal (i.e., unstretched and uncompressed) gasket is shown in FIG. 1(A). This gasket comprises an upper wall 2, a plurality of vertical members 4, and a bottom wall 6 including the bottom surface of vertical members 4 and upwardly directed folds 8. Voids 14, which are essentially rectangular but for the upward folds 8, are formed between the upper wall 2, vertical members 4, and folds 8. An attachment means comprising a horizontal extension 16 and a longitudinally elongate barbed flap 12 depending downwardly therefrom is provided at each side of gasket 10 to attach the gasket to a joint. Folds 8 have lower strength than the material used for upper wall 2 to facilitate the compression of the gasket.

As shown in FIG. 1(B), upward folds 8, having lesser strength than upper wall 2, tend to absorb the initial compressive force when a joint in which the gasket sits contracts. This compression collapses of voids 14. Ideally, upper wall 2 should compress by the same amount of bottom wall 6 if the gasket is to remain flat. However, this never happens in practice. Without wishing to be limited to any particular explanation of the phenomenon, it is believed that the compression of the gasket inevitably creates vertically directed forces. If these vertical forces are communicated to the upper wall 2, the upper wall will bend in response thereto. If the pleats 8 on the lower wall fold inward, as they immediately will when compressed, vertical forces will tend to be communicated to the upper wall. Moreover, upper wall 2 is much more readily bent as a unit than compressed, and once bent, lateral compressive forces will tend to bend it further rather than compress it. As the length of the bottom wall 6 decreases because of the upwardly directed folding, and upper wall 2, which is bent rather than compressed, retains substantially the same length, upper wall 2 necessarily bows upward and outward from the joint. Although the upward bowing may be masked somewhat by providing upper wall 2 with a concave upper surface, a nominally flat, horizontal surface is preferable for many applications. Moreover, the extent of the bowing is great enough to be difficult to mask effectively in this manner for joints of moderate nominal width.

There is thus a need for an expansion joint gasket that can be compressed without excessive upward bowing and which has a nominally flat upper wall surface. In addition, it would be desirable to provide a single gasket for use in both load-bearing and nonload-bearing applications.

BRIEF DESCRIPTION OF THE INVENTION

In accordance with the invention, a longitudinally continuous, elongated gasket for an expansion joint cover is provided. The gasket comprises, in cross section, a central body portion and two side portions, one at each edge of the central body portion.

The central body portion comprises essentially horizontal top and a bottom walls. The top wall preferably has a flat upper surface so that it may be walked upon without tripping and readily cleaned by traditional floor cleaning equipment. The top wall also comprises a series of longitudinal, essentially regularly spaced, alternating stronger and weaker regions, with the stronger regions being relatively more resistant to lateral compressive forces than the weaker regions. These stronger and weaker regions may be wider and narrower portions of the top wall, respectively. The bottom wall comprises a similar series of alternating stronger and weaker regions. To provide these regions, the bottom wall may comprise a series of longitudinally spaced, thicker regions joined by relatively thinner pleats.

Support between the top and bottom walls is provided by a pair of external walls and a series of internal walls. The external and internal walls are joined to the top and bottom walls in the vicinity of their stronger regions. In addition, each weaker region of the top wall is vertically opposite a stronger region of the lower wall and each stronger region of the top wall is vertically opposite a weaker region of the lower wall. The upper and lower walls are preferably of similar thicknesses. Because of the skewing of the weak and strong regions of the upper and lower walls and the arrangement of inner walls, the inner walls (and preferably also the outer walls) are slanted. These inner walls preferably form a series of alternating diagonal struts which tend to reinforce and enhance the durability of the upper wall.

The gasket may be further reinforced by a longitudinal spline inserted in a channel in the bottom wall of the gasket. This spline effectively creates an incompressible section of bottom wall, and hence should replace one of the relatively stronger sections of the bottom wall. This spline may also be attached to a slide supporting the lower wall of the gasket for enhancement of load-bearing capability.

The side portions of the gasket are provided to attach the gasket to the structural members of the joint. Any conventional attachment means may be used, such as screws or nails, or preferably ribbed legs adapted to engage corresponding grooves of the structural components.

The central body portion may be made of any kind of suitable elastomeric substance, such as a plastic or rubber having some degree of rigidity. Substances that are especially suitable for this purpose include polyvinyl chloride, neoprene, and a thermoplastic rubber manufactured by Monsanto Company and marketed commercially under the registered trademark Santoprene. Coextrusions of suitable materials may also be used. In particular, a dual durometer gasket having rigid ribbed legs may be desirable for certain applications.

BRIEF DESCRIPTION OF THE DRAWINGS

FIG. 1(A) shows the gasket in its nominal, uncompressed state.

FIG. 8(A) shows the joint in its nominal, uncompressed state. FIG. 8(B) shows the joint in its compressed state.

FIG. 9(A) shows the joint in its nominal, uncompressed state. FIG. 9(B) shows the joint in its compressed state.

DETAILED DESCRIPTION OF THE INVENTION

Figure 2:
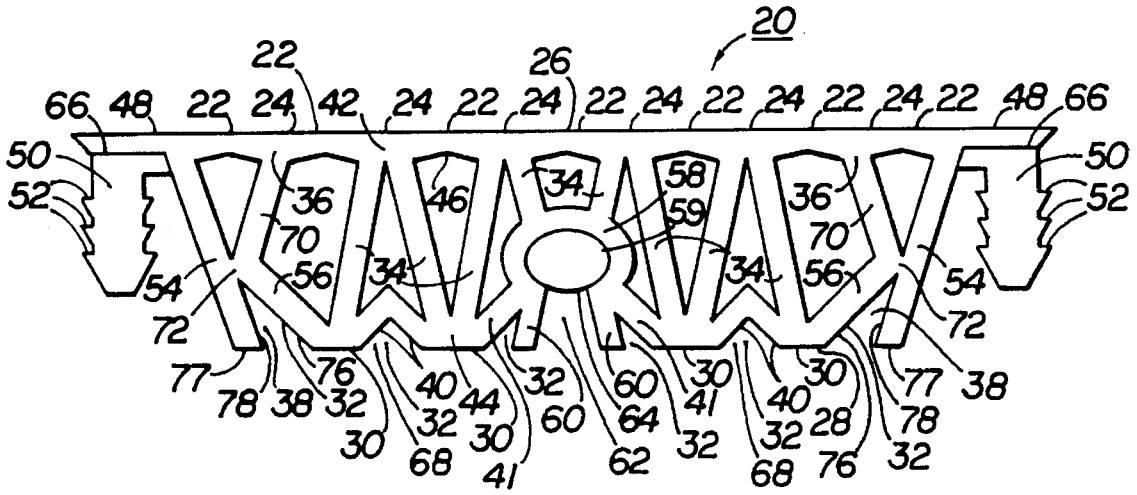
FIG. 2 is an illustration of a gasket in accordance with the invention in its nominal, uncompressed state, showing a spline inserted therein.

The present invention provides a gasket that effectively and substantially reduces outward bowing caused by compression. One embodiment of a gasket 20 in accordance with the invention is shown in transverse section in FIG. 2. Gasket 20 comprises an upper wall 26 preferably having an essentially flat upper surface, a lower wall 28 which is preferably continuous, but which may have features such as pleats, creases, and grooves on its bottom surface, and side walls 54 on either side, the central body portion of gasket 20 being essentially the portion between the side walls 54. Gasket 20 may be attached to a joint by conventional means, such as by screws or nails (not shown) attached through wings 48 at either end of gasket 20. Alternately, as shown in FIG. 2, each wing 48 may be provided with a leg 50 to fit within a groove of a respective structural member. (Any other suitable attachment method may also be used; for example, if it is advantageous to omit legs 50, the wings 48 themselves could be clamped in an appropriately modified groove.) Barbs 52 in legs 50 serve to provide a frictional attachment with the grooves. The gasket itself may be made of conventional materials, such as an extruded elastomer. In such an embodiment, legs 50 are formed as integral parts of gasket 20, and are made of the same material. Dual durometer gaskets may also be made conventionally by coextrusion. In this case, the portion of legs 50 below boundary 66 may preferably comprise a harder and more rigid material than the remainder of gasket 20.

Figure 1A:
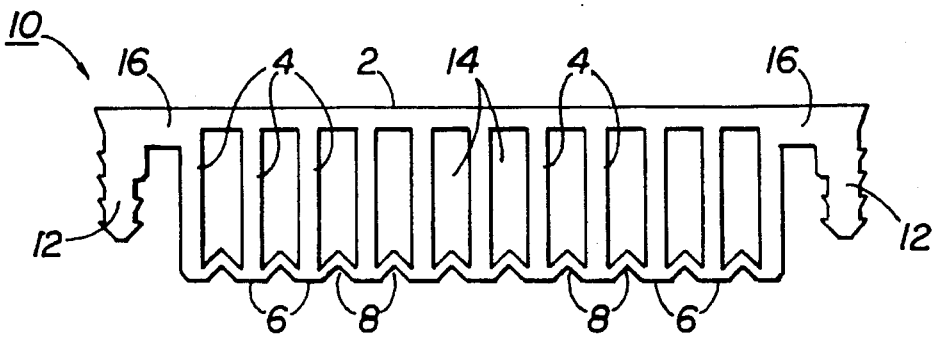
(PRIOR ART) FIG 1A
FIG. 1(A) and (B) show a prior art gasket.
Figure 1B:
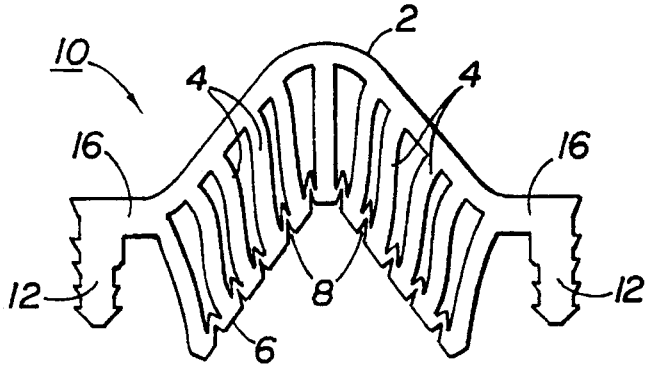
(PRIOR ART) FIG 1B
FIG. 1(B) shows the gasket in its compressed state, in which it is bowed considerably upward.

An important feature of the central body portion of gasket 20 is the essentially regular alternation of compressively strong regions 24 and weak regions 22 along the transverse profile of upper wall 26 and a similar profile of strong regions 30 and weak regions 32 along lower wall 28. Generally speaking, the strong regions 24 of upper wall 26 are disposed vertically opposite the weak regions 32 of lower wall 28, and the weak regions 22 of upper wall 26 are disposed vertically opposite the strong regions 30 of lower wall 28. Without wishing to be bound by any particular hypothesis, it is believed that this lateral skewing of opposing strong and weak features accounts for the surprisingly consistent and repeatable behavior of gasket 20 under pressure; namely, the resistance of the gasket to the generation of large, upward bulges of the upper wall 26 in response to compression. Tests made on gaskets similar to those shown in FIG. 1(A), but with upper wall 2 weakened above voids 14 (and hence vertically above pleats 8 in lower wall 6) do not exhibit similar behavior and instead bulge upward in a single bulge in a manner similar to unmodified gasket 10 shown in FIG. 1(*b*).

Any suitable means for weakening upper wall 26 at regions 22 may be used. As shown in FIG. 2, the weakening of upper wall 26 at regions 22 may be accomplished by reducing the thickness of upper wall 26 in those regions by forming concave regions 46 with either straight or arcuate walls in the lower surface of upper wall 26. Alternately, grooves or pleats may be provided in the upper surface of wall 26, but this may be less desirable from an aesthetic standpoint, and because a pleated surface may be harder to keep clean. The stronger regions 24 of upper wall 26 are regions of greater thickness, and which are further reinforced by internal walls 34. In addition to reinforcing upper wall 26 at those regions at which they are joined to it, internal walls 34 act as diagonal struts to provide rigidity to the structure. The number of internal walls 34 and their angles are determined by the required rigidity of gasket 20. Once the number and angles of internal walls 34 are determined, the spacing of the alternating weaker regions 22, 32 and stronger regions 24, 30 along the upper wall 26 and lower wall 28, respectively, may be determined.

Although lower wall 28 may be constructed with a flat bottom surface and internal V-shaped grooves in essentially the same way as upper wall 26, the lower surface of lower wall 28 is not visible when installed. Thus, weaker regions 32 in lower wall 28 may preferably comprise pleats 68 having relatively thin walls 40, similar to the pleats found in prior art gaskets. Stronger regions 30 may be formed by relatively thick sections of bottom wall 28 or the reinforcement created by the joining of an internal wall 34 with bottom wall 28, both of which are shown at 44. Regions 30 preferably have a uniformly level and flat bottom surfaces and the weaker regions 32 are preferably pleated inward to allow the gasket to sit on a flat load-bearing slide (not shown in FIG. 2), if desired.

To distribute compressive pressure against gasket 20, a ridge or wall of a structural member (not shown, but which may be a surface of a structural member engaging an adjacent leg 50) presses against a respective side wall 54, which preferably depend diagonally downward from upper wall 26, each side wall 54 sloping inwardly downward, away from wings 48 at the ends of gasket 20. Because the ridge or wall of the structural member is rigid, side walls 54 do not bend when compressed. Instead, some of the compressive forces are distributed onto internal walls 70 (which also serve the same purposes as internal walls 34 at their junctures 36 with the upper wall 26) and lower wall segment 56. Segments 56 of lower wall 28 preferably join respective side walls 54 a junctures 72 above a free end 77 of the side walls 54, forming notches 38 on the bottom of gasket 20 defined by surfaces 76 and 78 that are preferably directed diagonally upward towards the nearby ends or wings of gasket 20, allowing elongate spikes on an optional slide support to engage notches 38 in a manner to be explained below. Junctures 72 of lower wall segment 56, inner wall 70, and side wall 54 serve the purpose of a relatively stronger region in lower wall 28 opposite a weaker region 22 in top wall 26, because the portion of wall 56 under the adjacent stronger region 24 tends to arch so as to present a concave shape towards notch 38. Thus, the alternating pattern of stronger and weaker regions on upper wall 26 and lower wall 28 is effectively maintained, as is their skewed relationship.

Lower wall 28 may optionally have an elongate notch 62 communicating with an elongate recess 59, the recess disposed in vertical opposition to a weak region 22 in upper wall 26 and adapted to engage an elongate spline 64 therein. In the embodiment of FIG. 2, spline 64 is engaged in a recess formed within curved wall 58 at the end of notch 62. Walls 60 of notch 62 are preferably angled outward to allow easy insertion of spline 64 into recess 59. In the embodiment of FIG. 2, spline 64 can be inserted either by pressing it into recess 59, or by flexing gasket 20 at its ends. Spline 64, which need only fill so much of the recess as is necessary to prevent the spline from becoming disengaged (remembering that the gasket may be subject to stretching as well as compression) may comprise any rigid and relatively incompressible material that resists breaking or crushing, such as metal, plastic, or wood. Although an oval spline 64 is shown within curved wall 58, the shape of spline 64 and wall 58 are not critical. Spline 64 replaces and serves a purpose similar to a strong region 30 in lower wall 28 opposite a weaker region 22 in the upper wall.

Spline 64, when located as shown in FIG. 2, serves as a highly incompressible region in lower wall 28. Thus, when compressive forces are applied, the bottom wall 28 in the vicinity of spline 64, and particularly wall section 58, essentially retains its shape and horizontal dimensions. The upper wall 26 section immediately above spline 64, however, is subject to compressive forces, which collapse a weak region 22 above spline 64, making the upper wall shorter in this region. Therefore, the upper wall 26 tends to bend or fold markedly downward rather than upward over spline 64. This downward bending or folding is much less objectionable than upward bulging of wall 26, because it does not present as much of a tripping hazard, nor does it make the gasket 26 as subject to damage when cleaning equipment is used.

It should be noted that the downward bending or folding of upper wall 26 can be controlled by the horizontal extent of gasket 64. This downward bending tends to reduce the height, relative to a level floor, of irregularities that form in the top surface of upper wall 26, by pulling these irregularities downward. A gasket 64 having a larger horizontal extent causes the gasket to act as though a larger portion of lower wall 28 is incompressible. The larger this section, the greater the downward bend in upper wall 26, which becomes shorter as it compresses. To the extent that a greater downward bend in the region of spline 64 is a desirable feature, a wider spline may be permitted to partially disrupt the alternating pattern of weaker regions 32 and stronger regions 30 in the lower wall 28. To permit portions of lower wall 28 to compress around spline 64, a V-shaped notch is preferably formed by walls 41 and 60 adjacent insertion notch 62.

It should be noted that, without spline 64, notch 62 creates a broad, weak area in lower wall 28. In gasket 20, this area compresses more readily than the portion of upper wall 26 directly above notch 62; hence, gasket 20 will bulge outward and upward in the center region when compressed without a spline inserted. Thus, is provision is made for a spline, the spline may be required to be inserted for proper operation of the gasket.

Notch 62 need not be located midway between the left and right sides of gasket 20 as shown in FIG. 2, nor is the invention necessarily limited to having only one notch and spline. However, it may be desirable to have the notch or notches (and hence the spline or splines) symmetrically located to more evenly distribute their effect on the deformation of gasket 20 when the gasket is compressed.

Figure 3:
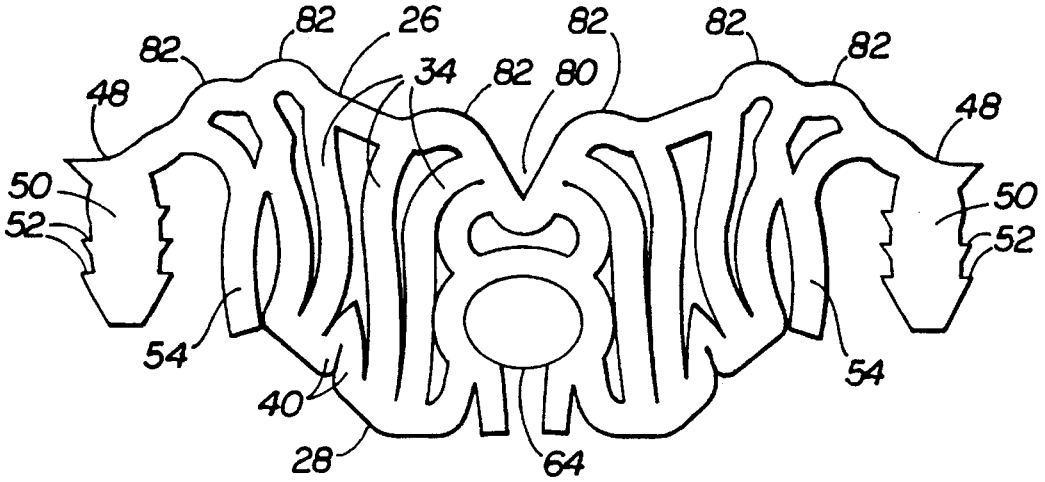
FIG. 3 is an illustration of the gasket of FIG. 2 in its compressed state, showing considerably less upward bowing than the gasket of FIG. 1(A) and (B).

FIG. 3 shows the gasket of FIG. 2 in a fully compressed joint, i.e., one that is compressed to the design limit. In the compressed state, gasket 20 does not bulge out of the joint, but rather upper wall 26 reliably and consistently turns inward in a V-shaped indentation 80 in the center, above spline 64. Some small outward bulges 82 of the upper wall 26 are apparent. However, because upper wall 26 is provided with an alternating pattern of strong sections 24 and weak sections 22, the entire upper wall 26 does not bulge out as a unit. As a result, small bulges 82 are of limited horizontal and vertical extent, and are largely masked by V-shaped indentation 80 in the center. The exact pattern of compression in any particular embodiment will vary depending upon such parameters as the number of internal walls and their angle relative to vertical, the presence or absence of splines, and the relative strengths of the various weak and strong regions in the upper and lower walls.

Figure 4:
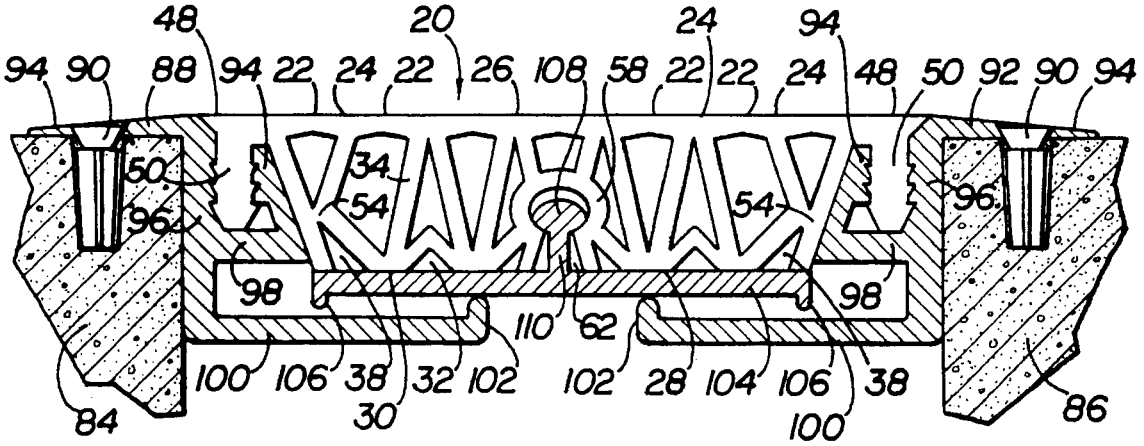
FIG. 4 is an illustration of the gasket of FIG. 2 in which an inverted-T-shaped slide is provided to enhance the load-bearing capabilities of the gasket. The gasket is shown in its nominal, uncompressed state.
Figure 5:
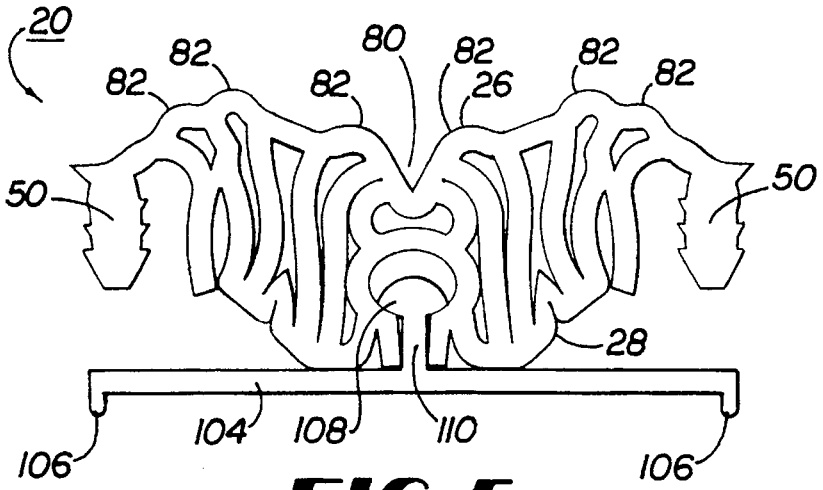
FIG. 5 is an illustration of the gasket of FIG. 4 and the supporting slide when the gasket is in its compressed state.
Figure 10:
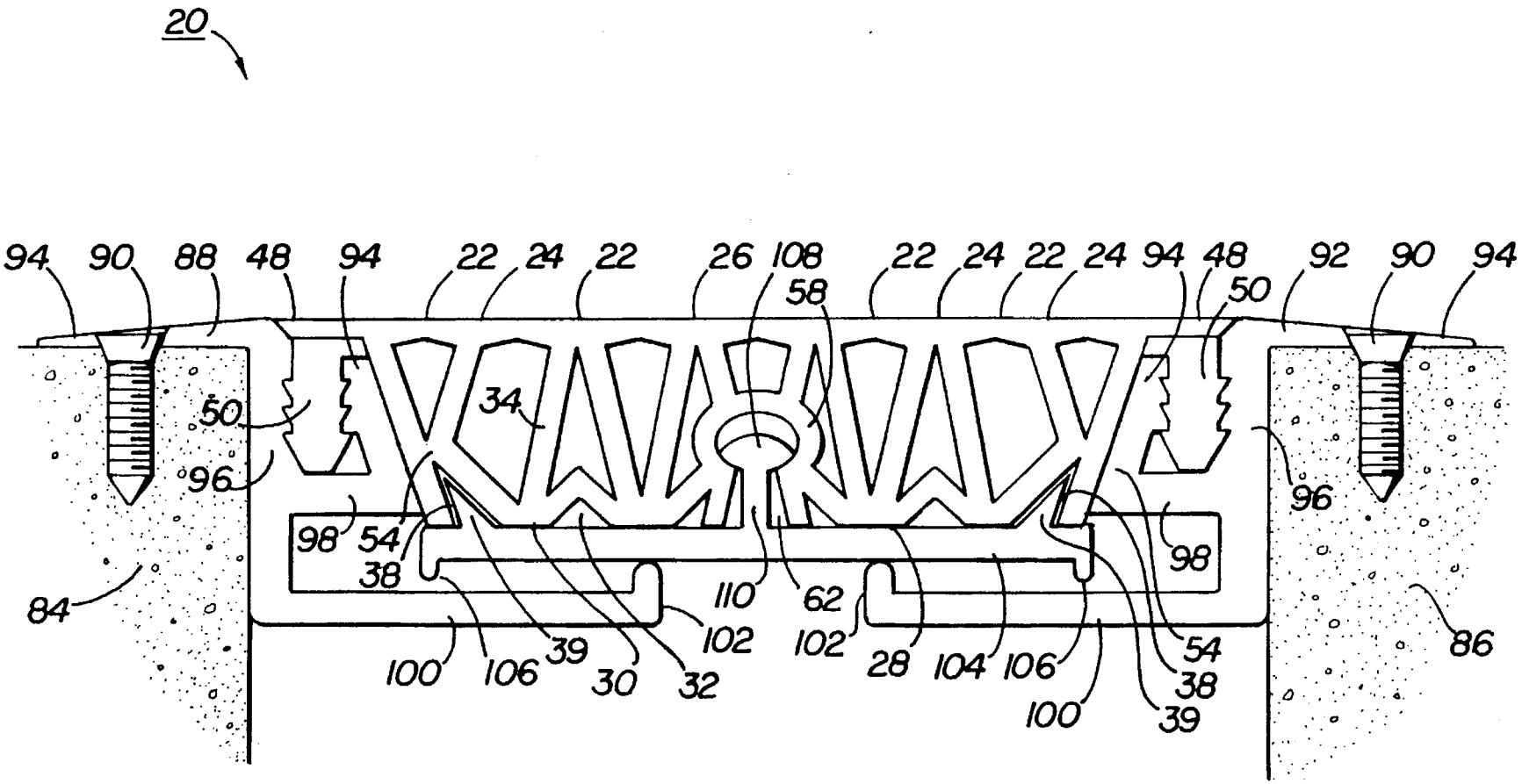
FIG. 10 is an illustration of the gasket of FIG. 4 that has elongate spikes to further prevent bowing of the gasket.

FIG. 4 shows the gasket of FIG. 2 in a typical load-bearing installation. In this type of installation, gasket 20 is installed between two joint members 88 and 92, which in turn are fixedly attached to structural members 84 and 86 by suitable means, such as screws 90 affixing fin portions 94 to their respective structural members 84 and 86. Structural members 84 and 86 may both be floor sections, or a floor and a wall section, for example. In FIG. 4, two floor sections are shown, so joint members 88 and 92 may be symmetric, as shown. Each joint member 88, 92 frictionally engages a respective leg 50 of gasket 20 between an arm 94 extending from the end of a supporting member 98 and a wall 96. Arms 94 also serve to communicate lateral compressive forces to side walls 54 of gasket 20. Lower arms 100 extending from each joint member supports an elongate, inverted-T-shaped slide 104 at their tips 102. Slide 104 provides load-bearing support for gasket 20 as well as a flat surface to engage lower wall 28 of gasket 20. The maximum contraction (i.e., reduction of the distance between structural members 84 and 86) that can be tolerated by the joint is determined by the nominal distance between tips 102, while the maximum expansion is determined by the sum of the distances between tips 102 of lower arms 100 and the ends 106 that tips 102 would meet during such expansion. Slide 104 also has an elongate vertical member 110 having an enlarged edge 108 that at least partially fills the space within the recess defined by lower wall section 58. Enlarged edge 108 of slide 104 serves the same purpose as independent spline 64 in FIGS. 2 and 3, and also serves the additional purpose of pinning the central section of gasket 20 down on slide 104. Thus, when gasket 20 is compressed, the resulting shape, shown in FIG. 5, is very similar to that of the compressed gasket 20 in FIG. 3, in which an independent spline and no slide is used. (The structural members 84, 86, and their attached joint members 88, 92 are not shown in FIG. 5.) As shown in FIG. 10, slide 104 may optionally have elongate spikes 39 to engage gasket 20 by filling notches 38. These spikes 39, by engaging and holding down the sloping inner side of outer wall 54 during compression, further aid in preventing upward bowing of upper wall 26 of gasket 20.

While the gaskets illustrated in FIGS. 2–5 are shown with recesses for engaging a spline, such recesses are not essential to the invention. Thus, FIGS. 6 and 7 show additional embodiments of gaskets in accordance with the invention.

Figure 6:
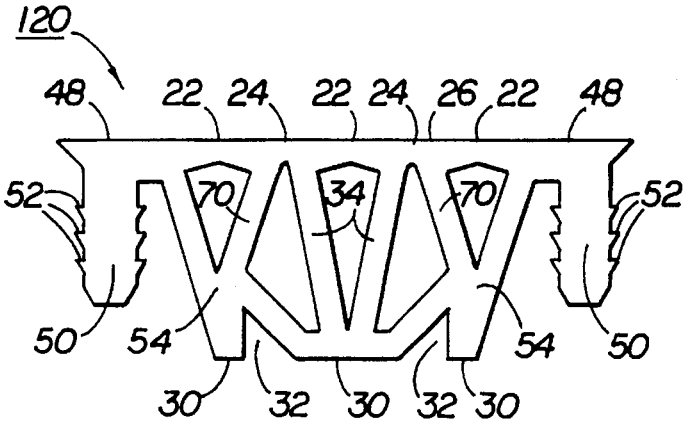
FIG. 6 is an illustration of a gasket in accordance with the invention that does not have a recess for a spline.

FIG. 6 shows a gasket 120 without a recess for a spline. Gasket 120, being shorter in transverse length than gasket 20 of FIGS. 2–5, also illustrates that gaskets in accordance with the invention may be designed to fit joints of different dimensions. Note that gasket 120 incorporates the sloping inner walls 34, including inner walls 70 that support end walls 54. Moreover, the essentially regular alternating pattern of strong regions 24 and weak regions 22 is incorporated into upper wall 26, and a similar alternating pattern of strong regions 30 and weak regions 32 is incorporated into lower wall 28, with strong regions 24 disposed vertically above weak regions 32 and weak regions 22 disposed above strong regions 30.

Figure 7:
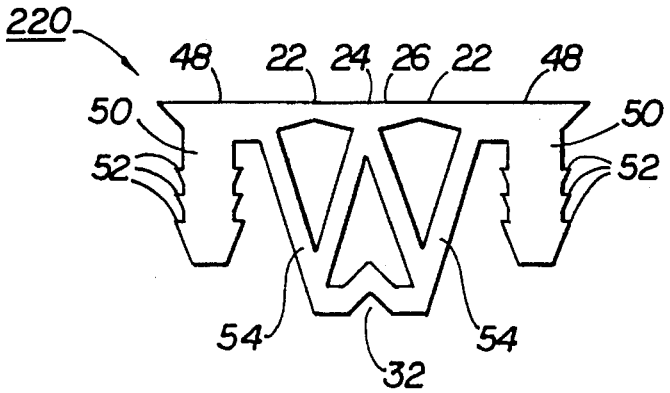
FIG. 7 is an illustration of another gasket in accordance with the invention that does not have a recess for a spline.

FIG. 7 shows a gasket 220 in accordance with the invention having minimum width. Upper wall 26 has an alternating pattern of strong regions 24 and weak regions 22, and lower wall 28 has an alternating pattern of strong regions 30 and weak regions 32, and these regions are disposed in the same vertical relationship as shown for gasket 120 in FIG. 6. Note that gaskets of such narrow width as gasket 220 cannot bow upward excessively in any event when compressed because of the short length of their upper walls.

The invention is considered to be useful in a wide range of joint sizes, and thus, the dimensions of gaskets embodying the invention may vary widely. Moreover, the dimensions are not critical. However, by way of example only, and not intending the invention to be limited thereby, in gaskets made of Santoprene(TM) or PVC, top wall 26 thicknesses ranging from 0.047 inches at weak points 22 to 0.062 inches adjacent stronger points 24, with intervals of approximately 0.25 inch between successive weak points 22, have been found satisfactory to provide the necessary variation in compression resistance. Similarly, bottom wall 28 thicknesses of 0.062 inches (measured vertically) at stronger sections 30, and 0.047 inches (measured perpendicularly to the wall) at V-shaped grooves forming weaker sections 32 have also been found satisfactory. These dimensions are dimensions taken by way of example from only a single application, and it is to be expected that they may vary considerably from one application to another. Also, it may be possible to provide the necessary variation in compression resistance without varying the thickness of the top and bottom walls, such as by using top and bottom walls having alternating regions of different compositions having appropriate compressive properties.

Figure 8A:
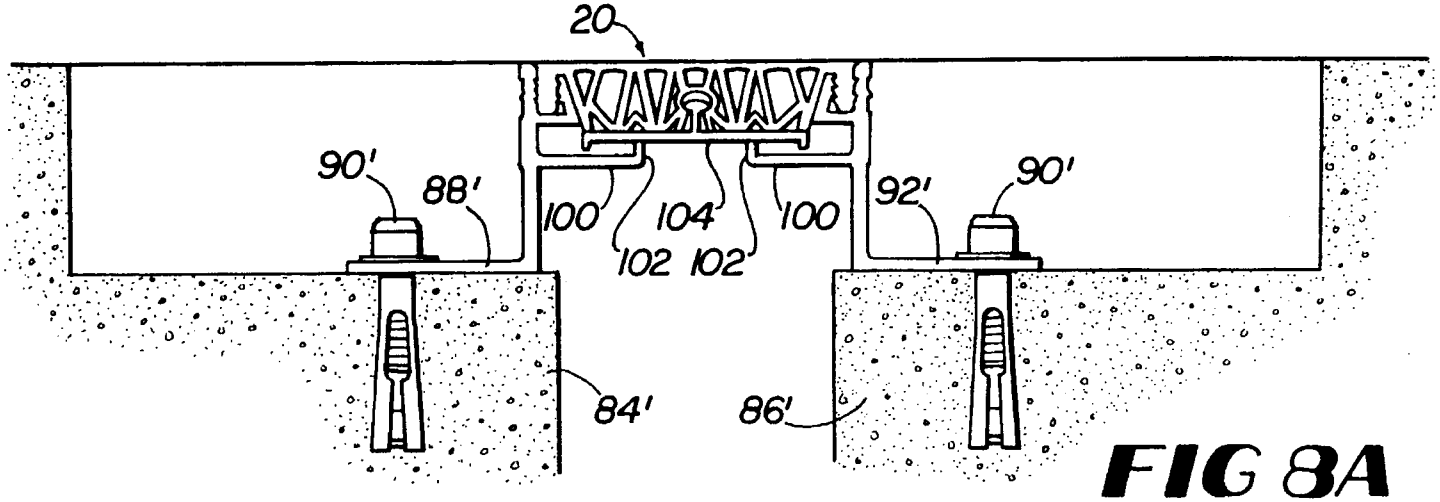
FIG. 8(A) and FIG. 8(B) show an alternate loadbearing joint employing a gasket in accordance with the invention.
Figure 8B:
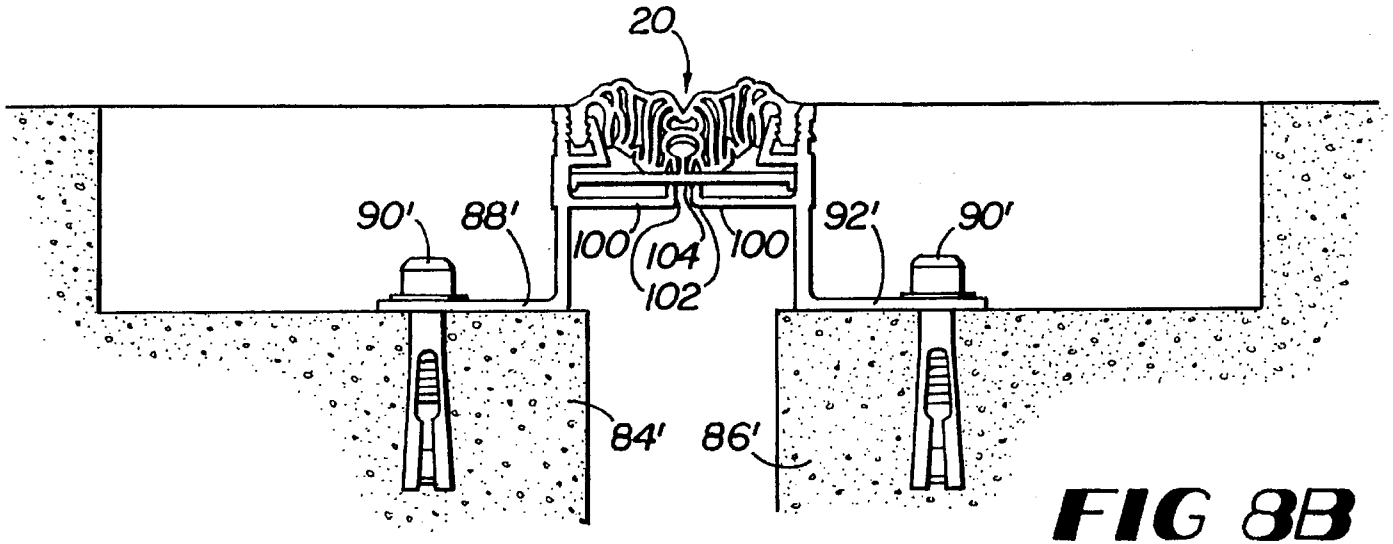

FIG. 8(A) and (B) show an alternate means of supporting a gasket in accordance with the invention in a load-bearing joint; such as between floor segments 84' and 86'. The support for gasket 20 in FIG. 8(A), shown in its nominal, uncompressed state, and FIG. 8(B), shown in its compressed state, is provided by members 88' and 92', which are secured at their bases 89' and 93', respectively, by bolts 90'. FIG. 8(B) shows the joint in the compressed state and the characteristic shape of gasket 20 when it is compressed.

Figure 9A:
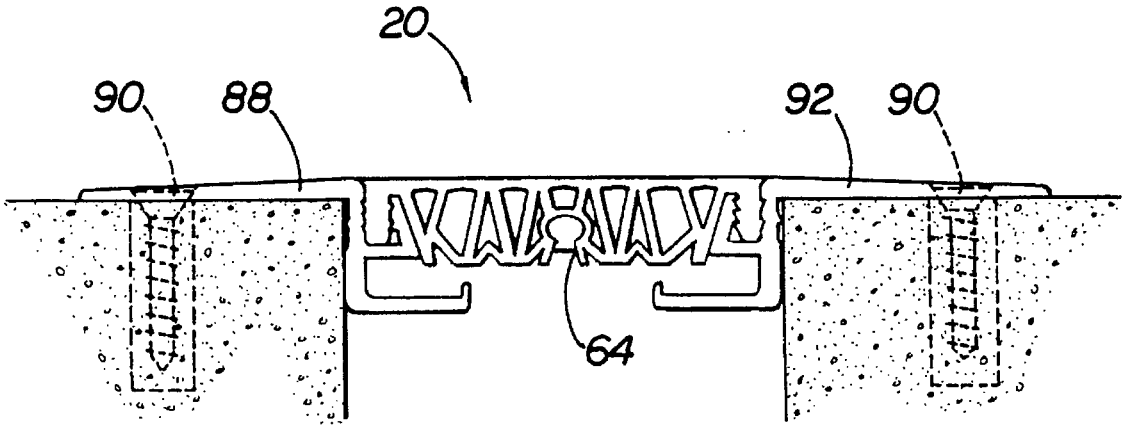
FIG.9(A) and FIG. 9(B) show an alternate nonloadbearing joint employing a gasket in accordance with the invention.
Figure 9B:
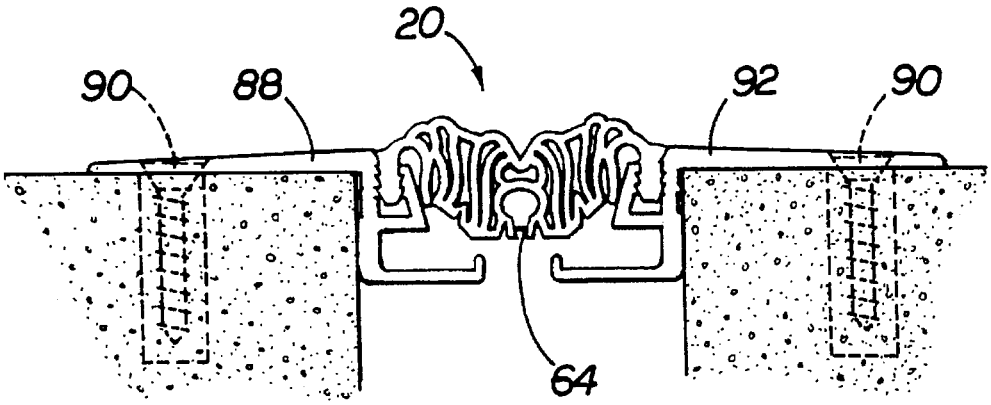

FIGS. 9(A) and (B) show a typical nonload-bearing application for a gasket 20 in accordance with the invention. These applications can include wall-ceiling and ceiling joints, for example. Note the absence of a slide 104, which is replaced by spline 64 in the illustrated application.

What is claimed is:

1. A gasket for a longitudinally elongate expansion joint cover, comprising:

a longitudinally elongate central body portion having a top, a bottom, and two opposed, transverse sides;

two side portions, one at either transverse edge of the central body portion;

the central body portion and said side portions being composed of an elastomeric substance and comprising an upper wall having a thickness and an essentially flat surface, a lower wall having a thickness and a surface which is opposed to the surface of the upper wall, a pair of side walls having a thickness and opposed surfaces and each adjacent a respective side portion, and a plurality of inner walls connecting the upper wall to the lower wall;

the upper wall including a first series of alternating longitudinal regions of greater and lesser compressive resistance, the first series of alternating regions disposed in essentially regular spacing along the upper wall;

the lower wall including a second series of alternating longitudinal regions of greater and lesser compressive resistance, the second series of alternating regions disposed in essentially regular spacing along the upper wall;

the regions of greater compressive resistance in the upper wall being generally vertically disposed above the regions of lesser compressive resistance in the lower wall;

the regions of lesser compressive resistance in the upper wall being generally vertically disposed above the regions of greater compressive resistance in the lower wall; and wherein the regions of lesser compressive resistance in the upper wall are regions of reduced upper wall thickness.

2. The gasket of claim 1, wherein at least one of the region of lesser compressive resistance in the lower wall comprises a first elongate V-shaped notch having sloped walls.

3. The gasket of claim 2, wherein the first elongate V-shaped notch points toward the upper wall.

4. The gasket of claim 2, wherein the inner walls each connect one of the regions of greater compressive resistance on the upper wall with a diagonally adjacent one of the regions of greater compressive resistance on the lower wall.

5. The gasket of claim 3, wherein the inner walls each connect one of the regions of greater compressive resistance on the upper wall with a diagonally adjacent one of the regions of greater compressive resistance on the lower wall.

6. The gasket of claim 3, wherein the regions of greater compressive resistance comprise regions having collinear, uniformly flat outer surfaces.

7. The gasket of claim 6, wherein the inner walls each connect one of the regions of greater compressive resistance on the upper wall with a diagonally adjacent one of the regions of greater compressive resistance on the lower wall.

8. The gasket of claim 7, wherein the side walls depend diagonally from the upper wall in a converging direction.

9. The gasket of claim 8, wherein the side walls have downwardly directed free ends, and the lower wall joins each of the side walls above their respective free ends, defining second and third elongate notches adjacent the side walls on the bottom of the gasket, the surfaces of the lower wall and of the respective side wall defining the second and third elongate notches being directed diagonally upward towards the side portion of the gasket nearest the respective side wall.

10. The gasket of claim 9, wherein the lower wall has a fourth notch communicating with a recess within the gasket, the fourth notch and the recess disposed vertically below one of the regions of relatively lesser compressive resistance of the upper wall, and the recess capable of engaging an elongate spline therein.

11. A floor joint assembly comprising the gasket of claim 10 and an inverted-T-shaped slide, the vertical members of the inverted-T-shaped slide having an enlarged edge engaged in the recess of the gasket, and at least a portion of the lower wall of the gasket in supportive engagement with top surfaces of horizontal members of the inverted-T-shaped slide.

12. The floor joint assembly of claim 11, wherein the inverted-T-shaped slide further comprises elongate spikes on the top surfaces of the horizontal members in engagement with the second and third notches.

13. The gasket of claim 1, wherein the inner walls each connect one of the regions of greater compressive resistance on the upper wall with a diagonally adjacent one of the regions of greater compressive resistance on the lower wall.

14. The gasket of claim 13, wherein the side walls depend diagonally from the upper wall in a converging direction.

15. The gasket of claim 14, wherein the side walls have downwardly directed free ends, and the lower wall joins each of the side walls above their respective free ends, defining second and third elongate notches adjacent the side walls on the bottom of the gasket, the surfaces of the lower wall and of the respective side wall defining the second and third elongate notches being directed diagonally upward towards the side portion of the gasket nearest the respective side wall.

16. The gasket of claim 9, wherein the lower wall has a fourth notch communicating with a recess within the gasket, the fourth notch and the recess disposed vertically below one of the regions of relatively lesser compressive resistance of the upper wall, and the recess capable of engaging an elongate spline therein.

17. A floor joint assembly comprising the gasket of claim 16 and an inverted-T-shaped slide, the vertical member of the inverted-T-shaped slide having an enlarged edge engaged in the recess of the gasket, and at least a portion of the lower wall of the gasket in supportive engagement with top surfaces of horizontal members of the inverted-T-shaped slide.

18. The floor joint assembly of claim 17, wherein the inverted-T-shaped slide further comprises elongate spikes on the top surfaces of the horizontal members in engagement with the second and third notches.

* * * * *